US011040851B2

(12) United States Patent
Florentino Liano et al.

(10) Patent No.: US 11,040,851 B2
(45) Date of Patent: Jun. 22, 2021

(54) ELEVATOR SYSTEM PASSENGER FRUSTRATION REDUCTION

(71) Applicant: Otis Elevator Company, Farmington, CT (US)

(72) Inventors: Blanca Florentino Liano, Cork (IE); Ankit Tiwari, South Windsor, CT (US); Piyush Agrawal, Cork (IE)

(73) Assignee: OTIS ELEVATOR COMPANY, Farmington, CT (US)

( * ) Notice: Subject to any disclaimer, the term of this patent is extended or adjusted under 35 U.S.C. 154(b) by 484 days.

(21) Appl. No.: 15/963,320

(22) Filed: Apr. 26, 2018

(65) Prior Publication Data

US 2019/0330011 A1 Oct. 31, 2019

(51) Int. Cl.
*B66B 1/46* (2006.01)
*B66B 1/34* (2006.01)

(52) U.S. Cl.
CPC ..... *B66B 1/468* (2013.01); *B66B 1/3446* (2013.01); *B66B 2201/211* (2013.01); *B66B 2201/401* (2013.01); *B66B 2201/402* (2013.01); *B66B 2201/4669* (2013.01)

(58) Field of Classification Search
CPC ..... B66B 1/468; B66B 1/3446
USPC ..... 187/380
See application file for complete search history.

(56) References Cited

U.S. PATENT DOCUMENTS 5,892,190 A * 4/1999 Morita ..... B66B 1/18 187/382
8,204,749 B2 * 6/2012 Hakkani-Tur ..... G10L 17/26 704/270
8,352,179 B2 * 1/2013 French ..... G01C 21/3415 701/410
8,438,127 B2 5/2013 Kurata et al.
9,000,928 B2 4/2015 Higgins
9,299,084 B2 3/2016 Argue et al.
9,547,408 B2 1/2017 Bromer
(Continued)

FOREIGN PATENT DOCUMENTS

CN 102009879 A 4/2011
CN 205328387 U 6/2016
(Continued)

OTHER PUBLICATIONS

Gunes, Hatice et al., "A Bimodal Face and Body Gesture Database for Automaitc Analysis of Human Nonverbal Affective Behavior", Proceedings of the 18th International Conference on Pattern Recognition (ICPR'06), IEEE, 2006, 6 pages.
(Continued)

*Primary Examiner* — David S Warren
(74) *Attorney, Agent, or Firm* — Cantor Colburn LLP

(57) ABSTRACT

A method of controlling an elevator system incudes collecting one or more frustration indicators of a passenger during usage of the elevator system by the passenger; collecting one or more frustration factors; correlating the one or more frustration factors to the one or more frustration indicators to generate one or more preferences for the passenger; generating a profile for the passenger in response to the correlating, the profile including the one or more preferences; and controlling operation of the elevator system in response to the one or more preferences to reduce frustration of the passenger during interaction with the elevator system.

15 Claims, 6 Drawing Sheets

(56) References Cited

U.S. PATENT DOCUMENTS

| | | | | |
|---|---|---|---|---|
| 9,642,536 | B2 | 5/2017 | Kashef et al. | |
| 9,957,132 | B2 * | 5/2018 | Berryhill | B66B 1/2458 |
| 10,457,521 | B2 * | 10/2019 | Legeret | B66B 5/025 |
| 10,547,917 | B2 * | 1/2020 | Copeland | H04L 67/1097 |
| 10,674,199 | B2 * | 6/2020 | Hsu | B66B 3/008 |
| 2012/0120219 | A1 * | 5/2012 | Wang | G06K 9/00308 348/77 |
| 2016/0110591 | A1 | 4/2016 | Smith et al. | |
| 2016/0122157 | A1 | 5/2016 | Keser | |
| 2016/0325962 | A1 | 11/2016 | Blandin et al. | |
| 2017/0021282 | A1 * | 1/2017 | Comploi | B60W 50/10 |
| 2017/0362054 | A1 * | 12/2017 | Legeret | B66B 5/025 |
| 2017/0369275 | A1 | 12/2017 | Saraswat et al. | |
| 2017/0370732 | A1 | 12/2017 | Bender et al. | |
| 2019/0241398 | A1 * | 8/2019 | Marvin | B66B 1/28 |
| 2019/0330011 | A1 * | 10/2019 | Florentino Liano | B66B 1/468 |

FOREIGN PATENT DOCUMENTS

| | | | | |
|---|---|---|---|---|
| CN | 106315319 | A | | 1/2017 |
| CN | 106682090 | A | | 5/2017 |
| CN | 107000959 | A | | 8/2017 |
| JP | 01236178 | A | * | 9/1989 |
| JP | 2013234050 | A | | 11/2013 |

OTHER PUBLICATIONS

Kalili, Amir Hossein et al., "Hierarchal Preference Learning for Light Control from User Feedback", Ambient Intelligence Research Lab, Stanford University, CA, USA, IEEE, 2010, pp. 56-62.

Kapoor, Ashish et al., "Automatic Prediction of Frustration", Int. J. Human—Computer Studies, Jan. 22, 207, 26 pages.

European Search Report for application EP 19170310.7, dated Sep. 26, 2019, 7 pages.

* cited by examiner

Service Phase

ELEVATOR SYSTEM PASSENGER FRUSTRATION REDUCTION

BACKGROUND

The subject matter disclosed herein generally relates to elevator systems and, more particularly, to elevator systems configured to reduce passenger frustration.

Existing elevator systems attempt to provide improved service to passengers. Typically, elevator dispatching algorithms aim to reduce the average waiting time for passengers. Passengers, however, may have different preferences such as where to wait, with whom to travel, etc. Currently, passengers cannot provide this feedback, so elevator dispatching cannot be customized for a specific passenger based on their preferences.

SUMMARY

According to an embodiment, a method of controlling an elevator system incudes collecting one or more frustration indicators of a passenger during usage of the elevator system by the passenger; collecting one or more frustration factors; correlating the one or more frustration factors to the one or more frustration indicators to generate one or more preferences for the passenger; generating a profile for the passenger in response to the correlating, the profile including the one or more preferences; and controlling operation of the elevator system in response to the one or more preferences to reduce frustration of the passenger during interaction with the elevator system.

In addition to one or more of the features described herein, or as an alternative, further embodiments may include ranking the one or more frustration factors from more frustrating to less frustrating.

In addition to one or more of the features described herein, or as an alternative, further embodiments may include ranking the one or more preferences from most likely to reduce frustration to least likely to reduce frustration.

In addition to one or more of the features described herein, or as an alternative, further embodiments may include controlling operation of the elevator system to reduce total frustration of a group of passengers during interaction with the elevator system.

In addition to one or more of the features described herein, or as an alternative, further embodiments may include wherein the one or more frustration factors comprise internal frustration factors and external elevator factors.

In addition to one or more of the features described herein, or as an alternative, further embodiments may include wherein the internal frustration factors comprise one or more of conditions within the elevator car, wait time for the elevator car, number of other passengers in the elevator car, number of stops during travel and overall travel time.

In addition to one or more of the features described herein, or as an alternative, further embodiments may include wherein the external frustration factors include local traffic, local weather, time of day and day of week.

According to another embodiment, an elevator system includes an elevator car located within an elevator shaft; at least one sensor; an elevator controller arranged to control travel of the elevator car; and a computing system in communication with the at least one sensor and the elevator controller, wherein the computing system is configured to implement: collecting one or more frustration factors of a passenger; correlating the one or more frustration factors to the one or more frustration indicators to generate one or more preferences for the passenger; generating a profile for the passenger in response to the correlating, the profile including the one or more preferences; and controlling operation of the elevator system in response to the one or more preferences to reduce frustration of the passenger during interaction with the elevator system.

In addition to one or more of the features described herein, or as an alternative, further embodiments may include wherein the controller is configured to implement ranking the one or more frustration factors from more frustrating to less frustrating.

In addition to one or more of the features described herein, or as an alternative, further embodiments may include wherein the controller is configured to implement ranking the one or more preferences from most likely to reduce frustration to least likely to reduce frustration.

In addition to one or more of the features described herein, or as an alternative, further embodiments may include wherein the controller is configured to implement controlling operation of the elevator system to reduce total frustration of a group of passengers during interaction with the elevator system.

In addition to one or more of the features described herein, or as an alternative, further embodiments may include wherein the one or more frustration factors comprise internal frustration factors and external elevator factors.

In addition to one or more of the features described herein, or as an alternative, further embodiments may include wherein the internal frustration factors comprise one or more of conditions within the elevator car, wait time for the elevator car, number of other passengers in the elevator car, number of stops during travel and overall travel time.

In addition to one or more of the features described herein, or as an alternative, further embodiments may include wherein the external frustration factors include local traffic, local weather, time of day and day of week.

According to another embodiment, a computer program product for controlling an elevator system, the computer program product comprising a non-transitory computer readable storage medium having program instructions embodied therewith, the program instructions executable by a processor to cause the processor to implement operations comprising: collecting one or more frustration indicators of a passenger during usage of the elevator system by the passenger; collecting one or more frustration factors; correlating the one or more frustration factors to the one or more frustration indicators to generate one or more preferences for the passenger; generating a profile for the passenger in response to the correlating, the profile including the one or more preferences; and controlling operation of the elevator system in response to the one or more preferences to reduce frustration of the passenger during interaction with the elevator system.

Technical effects of embodiments of the present disclosure include elevator systems configured to operate and/or adjust functionality in response to passenger frustration. Technical effects of the present disclosure also include elevator systems configured to learn frustration factors for passengers.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
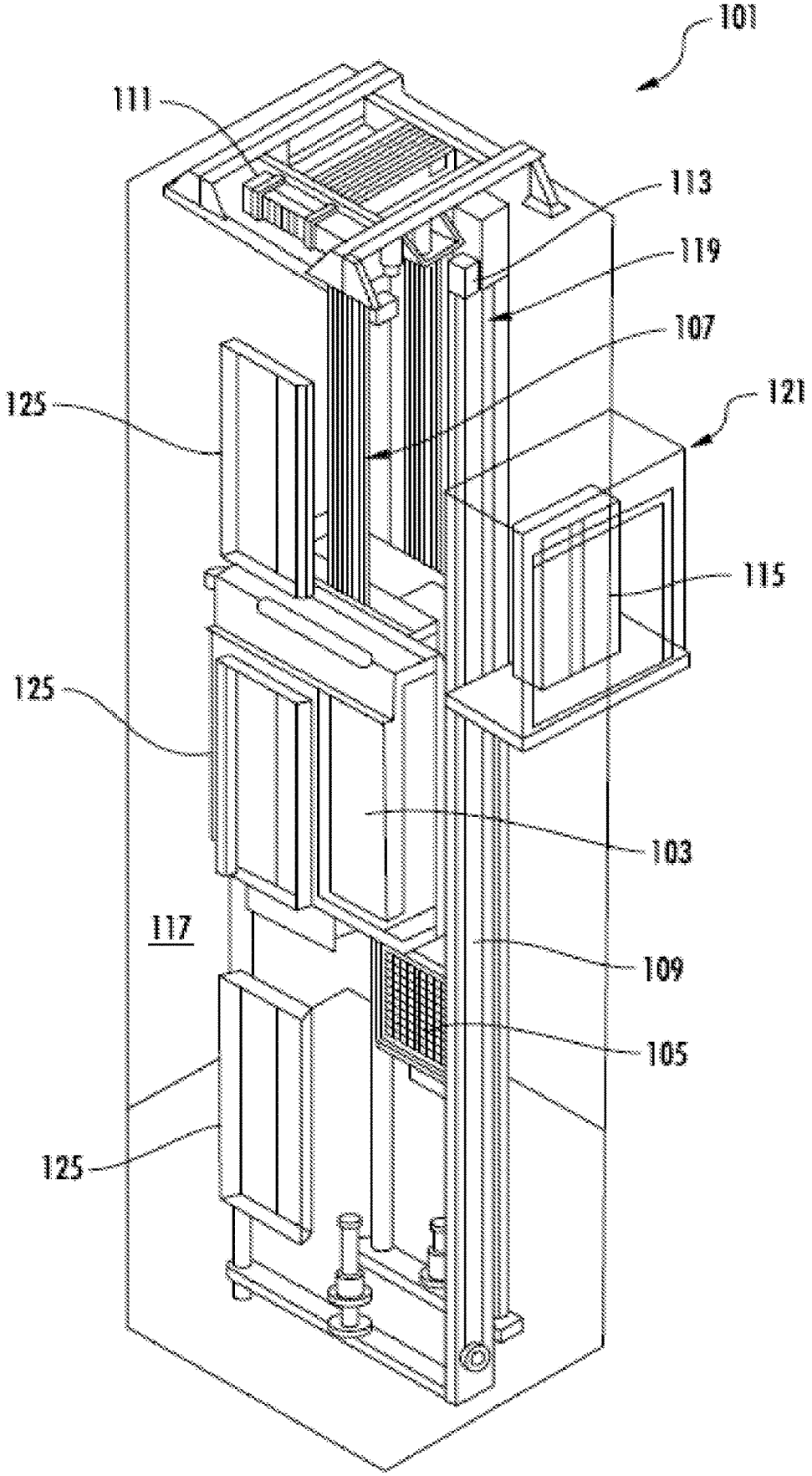
FIG. 1 depicts an elevator system in an example embodiment.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101. In some embodiments, the elevator controller 115 can be configured to control conditions within the elevator car 103, including, but not limited to, lighting, display screens, music, spoken audio words, temperature in the car, etc.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Embodiments provided herein are directed to apparatuses, systems, and methods related to learning preferences for a passenger and providing elevator service in response to preferences for that passenger. Elevator systems of the present disclosure can include computing systems to generate instructions to take certain actions or responses, store certain operating mode information, store user profiles, enable control or communication, etc.

Figure 2:
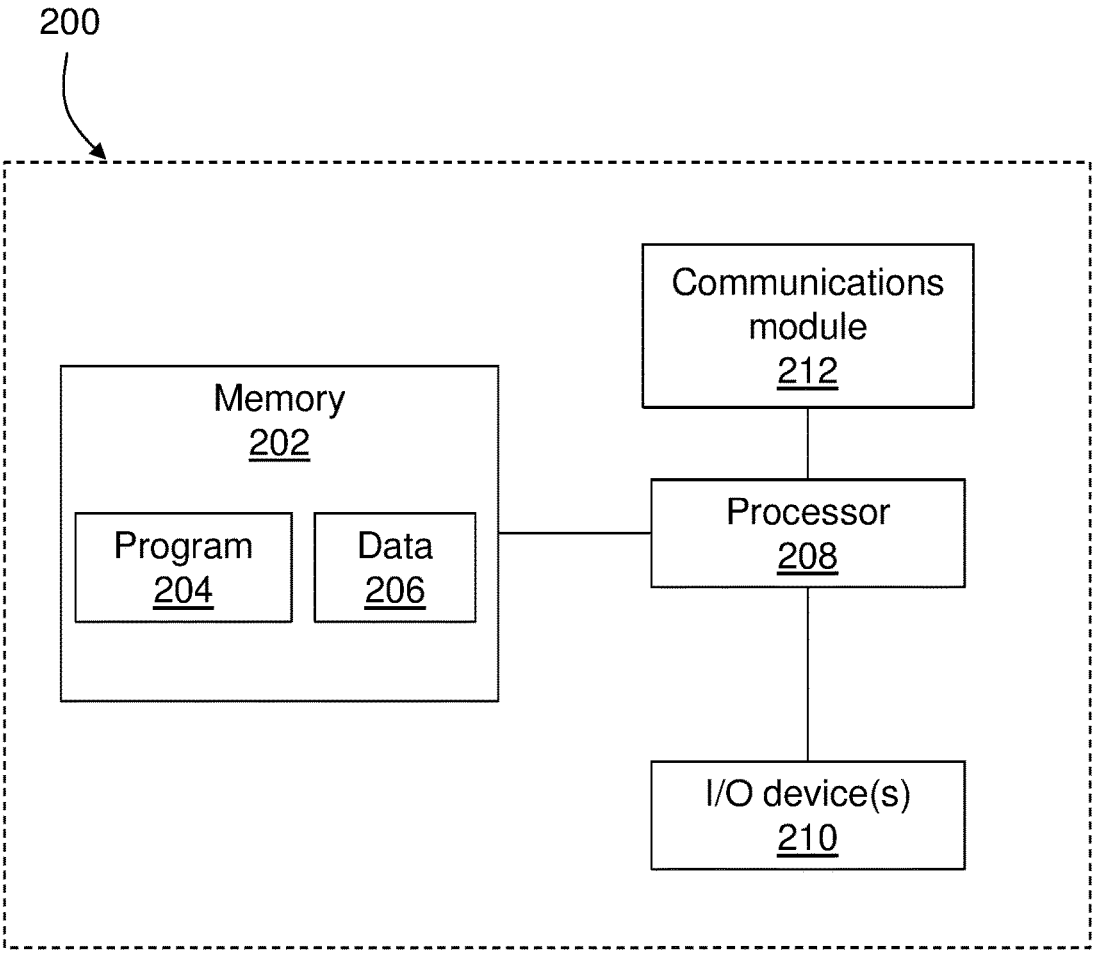
FIG. 2 depicts a computing system in an example embodiment.

For example, referring now to FIG. 2, an exemplary computing system 200 that can be incorporated into elevator systems of the present disclosure is shown. The computing system 200 may be a stand-alone system (e.g., a server) or configured as part of the elevator controller 115 shown in FIG. 1. The computing system 200 includes a memory 202 which may store executable instructions and/or data. The executable instructions may be stored or organized in any manner and at any level of abstraction, such as in connection with one or more applications, processes, routines, procedures, methods, etc. In some embodiments, the computing system 200 may incorporate computing algorithms that are arranged to enable transmission of all collected sensing or video data to an elevator control system. In other embodiments, predetermined or relevant meta-data can be transmitted to the elevator control system, with such embodiments requiring less bandwidth, digital memory, and/or power. As an example, at least a portion of the instructions are shown in FIG. 2 as being associated with a program 204.

Further, as noted, the memory 202 may store data 206. The data 206 may include profile or registration data, elevator car data, a device identifier, or any other type(s) of data as will be appreciated by those of skill in the art. The instructions stored in the memory 202 may be executed by one or more processors, such as a processor 208. The processor 208 may be operative on the data 206.

The processor 208 may be coupled to one or more input/output (I/O) devices 210. In some embodiments, the I/O device(s) 210 may include one or more of a keyboard or keypad, a touchscreen or touch panel, a display screen, a microphone, a speaker, a mouse, a button, a remote control, a joystick, a printer, a telephone or mobile device (e.g., a smartphone), a sensor, video, etc. The I/O device(s) 210 may be configured to provide an interface to allow a user to interact with the computing system 200. For example, the I/O device(s) 210 may support a graphical user interface (GUI) and/or voice-to-text capabilities.

The components of the computing system 200 may be operably and/or communicably connected by one or more buses. The computing system 200 may further include other features or components as known in the art. For example, the computing system 200 may include one or more transceivers and/or devices configured to transmit and/or receive information or data from sources external to the computing system 200. For example, in some embodiments, the computing system 200 may be configured to receive information over a network (wired or wireless). The information received over the network may be stored in the memory 202 (e.g. as data 206) and/or may be processed and/or employed by one or more programs or applications (e.g., program 204). As shown, the computing system 200 includes a communications module 212 that can include various communications components for transmitting and/or receiving information and/or data over a variety of networks.

The computing system 200 may be used to execute or perform embodiments and/or processes described herein. For example, the computing system 200, when configured as part of an elevator control system, may be used to receive commands and/or instructions, and may further be configured to control operation of and/or features of an elevator car.

Figure 3:
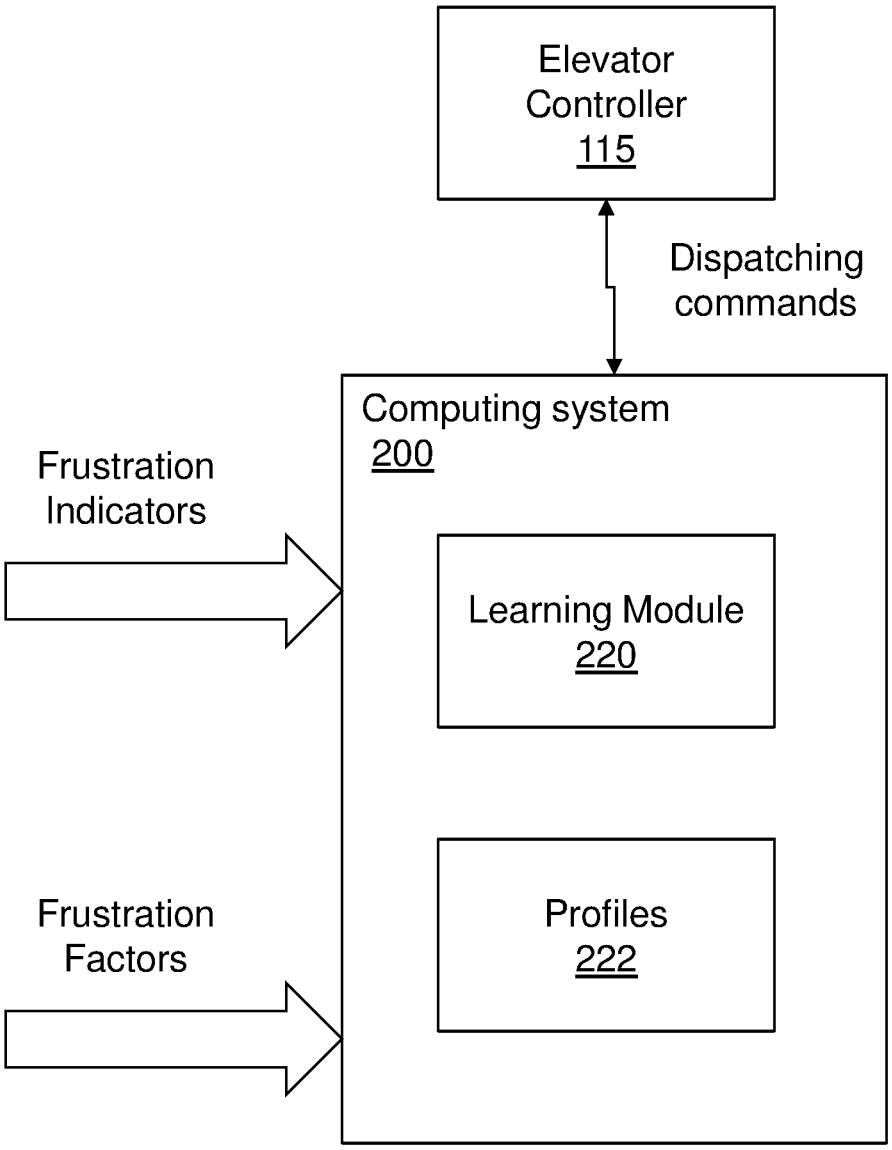
FIG. 3 depicts data flows to and from the computing system in an example embodiment.

FIG. 3 depicts data flows to and from the computing system 200 in an example embodiment. During a learning phase (described in further detail with respect to FIG. 4), the computing system 200 receives frustration indicators for a passenger and frustration factors. The computing system 200 executes a learning module 220 that accumulates the frustration indicators and frustration factors and determines preferences for the passenger. The learning module 220 may be implemented by processor 208 executing a program 204 in memory 202 (FIG. 2). The preferences for the passenger are then stored in a profile 222 for that passenger. The profiles 222 may be stored as data 206 in memory 202 (FIG. 2). During a service phase, the preferences are accessed and used to control elevator service for that passenger by the control system 200 sending dispatching commands to the elevator controller 115.

Figure 4:
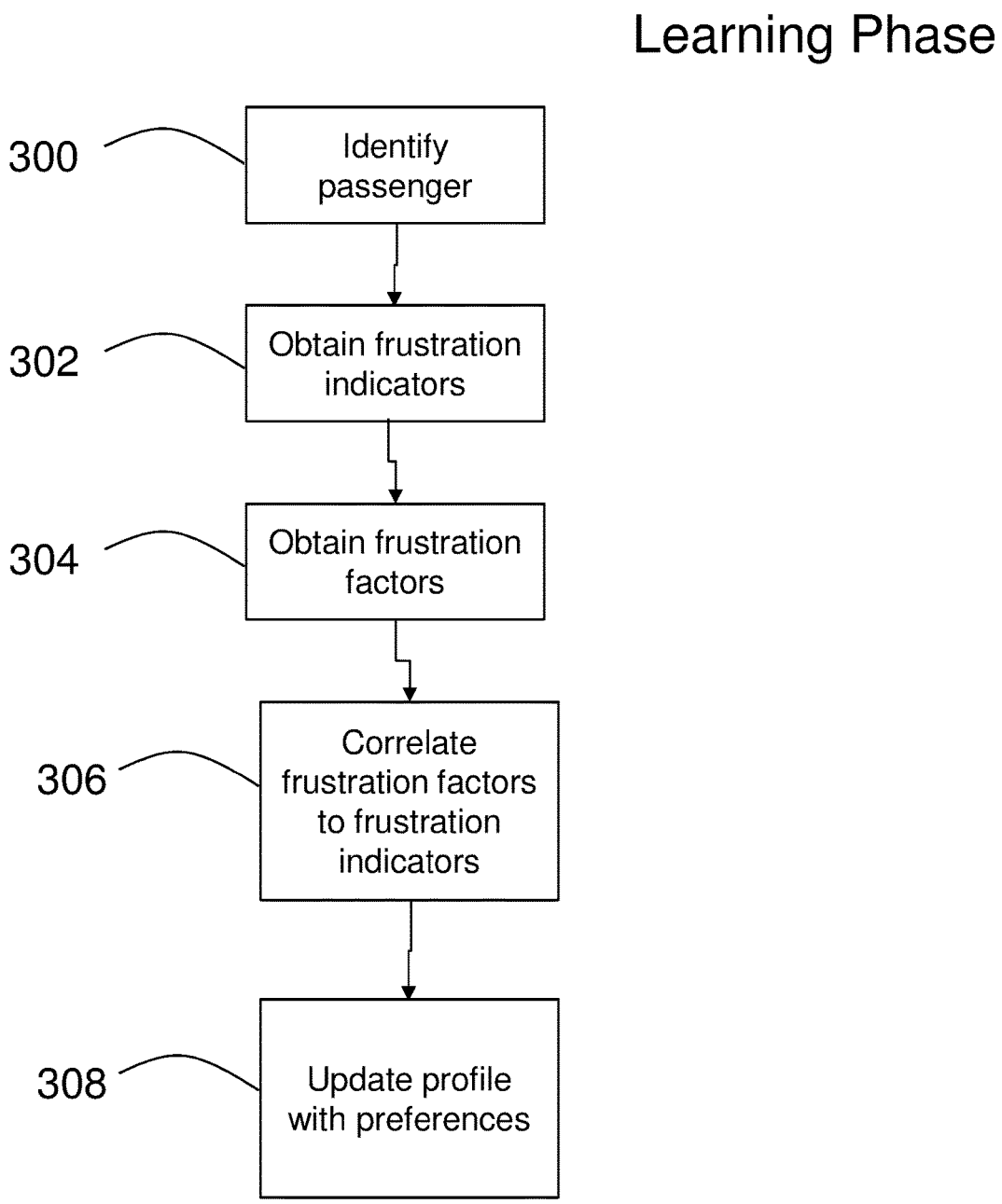
FIG. 4 depicts a process for learning preferences for a passenger to reduce passenger frustration in an example embodiment.

FIG. 4 depicts a learning phase process during which the computing system 20 learns preferences for a passenger to reduce passenger frustration, in an example embodiment. The process begins at 300 where the computing system 200 identifies a passenger accessing the elevator system 100. The identity of the passenger may be determined using a variety of techniques including (a) identifying the passenger through a mobile device carried by the passenger, (b) identifying the passenger through cameras and face recognition software, (c) identifying the passenger based on biometric measurements such as a fingerprint (when pressing elevator call button) or iris recognition and (d) identifying the passenger by an identification medium (e.g., badge with RFID, magnetic stripe, etc.).

Figure 5:
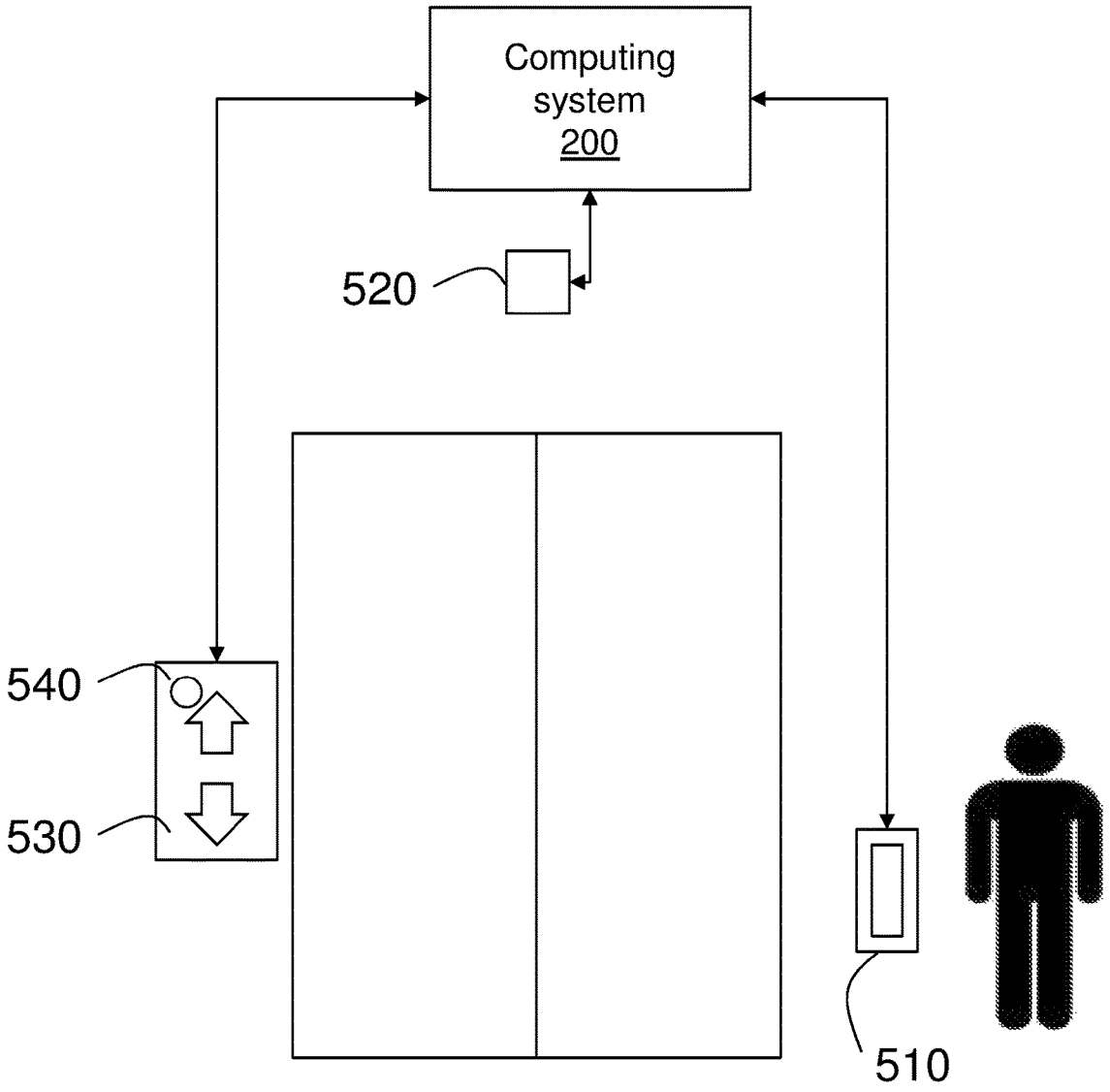
FIG. 5 depicts an elevator lobby in an example embodiment.

Once the passenger is identified, the computing system 200 begins collecting frustration indicators for the passenger. The frustration indicators may be collected for the entire period the passenger is interacting with the elevator system (e.g., waiting, boarding, traveling, de-boarding). FIG. 5 depicts an elevator lobby in an example embodiment including systems for detecting passenger frustration indicators. A passenger device 510, such as a smartphone or wearable, can monitor passenger physiological information (e.g., heart rate, body temperature, breathing, sweating, gait, etc.). When the passenger walks into a building or near an elevator system having embodiments described herein, detected passenger physiological state information and/or user data can be sent from the user device 510 to the computing system 200 (e.g., automatically, upon request from the elevator system, or pushed from the user device).

A sensor 520 may also detect frustration indicators for the passenger. For example, optical sensors, video cameras, microphones, thermal sensors, radar technologies, etc. can be used to detect the presence of passengers near or within an elevator car and can measure frustration indicators for the passenger. A camera, for example, may capture facial expressions/body language (e.g., discomfort, frequently looking at lantern, watch, frequently pressing call button, etc.). If the user device 510 includes a camera, the computing system 200 may evaluate images taken on the user device 510 to provide a frustration indicator for the passenger (e.g., angry facial expression in a selfie). A biometric sensor may obtain frustration indicators for the passenger through passenger interaction with the biometric sensor. In FIG. 5, the hall call panel 530 (or other fixture such as a destination call kiosk) includes a biometric sensor 540 that may detect or measure characteristics from the passenger's hand (e.g., heart rate, body temp, etc.). Biometric sensor 540 may also be used to identify the passenger (e.g., through fingerprint analysis).

Although the sensors in FIG. 5 are shown in an elevator lobby, similar sensors may be used inside the elevator car 103 and at each landing of the elevator system 100. Thus, frustration indicators for the passenger may be collected while the passenger is waiting for elevator service, while the passenger is traveling in the elevator car and when the passenger exits the elevator car.

Referring back to FIG. 4, at 304 the computing system 200 collects frustrating factors coincident with the passenger frustration indicators. The frustration factors may include elevator frustration factors, which refers to frustration factors experienced as a result of using the elevator system 100. Examples of elevator frustration factors include wait time for an elevator car, number of other passengers in an elevator car, number of stops during travel, overall travel time (includes waiting time and travel time). Elevator frustration factors may also include conditions in the elevator car such as lighting, music, temperature, etc. The frustration factors may include external frustration factors, such as current local weather, current local traffic, day of week, time of day, etc. These external frustration factors may be obtained by the computing system 200 via a network connection to an external source of such factors (e.g., linking to a server providing local traffic and local weather via an RSS feed).

At 306, the computing system 200 executes the learning module 220 to correlate the frustration indicators for the passenger with the frustration factors to determine how the frustration factors affect the frustration indicators for the passenger. The learning module 220 may use a variety of techniques to correlate the frustration indicators for the passenger with the frustration factors. For example, the learning module 220 may implement a Bayesian network to identify probabilistic relationships between the frustration indicators for the passenger with the frustration factors. Other methods used by learning module 220 may include neural networks, decision trees and association rules. The learning module 220 may also rank the frustration factors (or combinations of frustration factors) from most frustrating for the passenger to least frustrating to the passenger. The learning module 220 may also learn (e.g., enrich) a first passenger profile based on other passenger's frustration profiles that are similar to the first passenger profile by, for example, using recommender system methods such as content based, collaborative filtering, demography recommender or knowledge based recommender.

Once a correlation between the frustration indicators for the passenger and the frustration factors is determined, a user profile 222 for that passenger can be updated with preferences at 308. These preferences are then used in controlling the elevator system in response to a call from that passenger. As a simple example, a passenger may exhibit high frustration indicators whenever there are four or more other passengers in the elevator car with the passenger or whenever elevator occupancy exceeds a percentage (e.g., 60%) of total capacity. From this information, the learning module 220 creates a preference in the user profile 222 for that passenger that the number of other passengers should be less than four, when possible. In a more complex example, the correlation between the frustration indicators for the passenger and the frustration factors may indicate that on Monday mornings the number of other passengers causes the most frustration, whereas on Friday afternoons the number of stops during transit causes the most frustration. The preferences may be considered proportionally related to the frustration factors, such that a frustration factor causing a high frustration indicator is associated with a strong preference. The preferences may also be ranked, from most likely to reduce frustration to least likely to reduce frustration, based upon the correlation between the frustration factors and frustration indicators for the passenger.

It is understood that the preferences in a user profile may include a wide variety of factors including reducing time waiting, reducing total travel time, reducing number of stops, reducing number of other passengers, elevator car lighting, elevator car music, elevator car temperature, etc. Embodiments are not limited to the preferences provided as examples in this disclosure. Similarly, the frustration indicators and frustration factors may include a wide variety of items. Embodiments are not limited to the frustration indicators and frustration factors provided as examples in this disclosure.

The learning phase of FIG. 4 may be employed over a period of time such as weeks or months. At the beginning of the learning phase, a user's profile may be initialized with preferences that have been learned from other users and linked with their demographics, corporate affiliations, etc. The learning phase can also be reinitiated if the passenger appears to experience frustration levels that increase over time.

Figure 6:
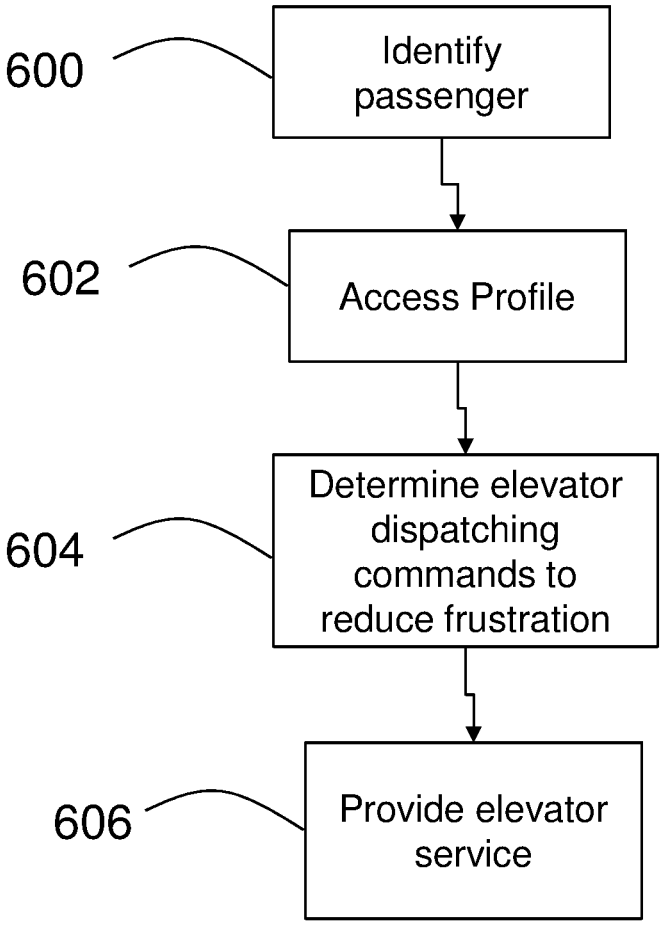
FIG. 6 depicts a process for providing elevator service to reduce passenger frustration in an example embodiment.

FIG. 6 depicts a service phase process during which the computing system 200 applies the preferences to reduce passenger frustration, in an example embodiment. The process begins at 600 where a passenger is identified. This may be performed using the same techniques as described with reference to block 300 of FIG. 4. If a passenger cannot be identified (e.g., a visitor to an office building), the elevator system will provide default elevator service and attempt to satisfy default preferences.

At 602, the passenger's user profile is accessed to retrieve preferences for that passenger. As noted above, the preferences may be ranked from most likely to reduce frustration to least likely to reduce frustration. At 604, the computing system 200 determines elevator dispatching commands for this passenger in order to satisfy the preferences, and therefore reduce (or minimize) passenger frustration. The elevator dispatching commands may include control of travel of the elevator car and control of conditions in the elevator car (e.g., lighting, sound, temperature, etc.).

There will be situations where multiple passengers have requested elevator service at the same time. In such situations, the computing system 200 obtains preferences from the user profiles of each passenger and determines the elevator dispatching commands that reduces the total frustration experienced by the group of passengers. This may be performed using data optimization techniques to locate a global minimum of total frustration for all passengers, rather than a local minimum for a single passenger.

At 606, the computing system 200 provides the elevator dispatching commands to the elevator controller 115. It is understood, as noted above, that the computing system 200 and elevator controller 115 may be implemented by the same device. The elevator controller 115 then assigns one or more elevator cars 103 to the one or more passengers who have made calls (e.g., hall or destination) to the elevator system. The elevator controller 115 may also control conditions within the elevator car 103, including, but not limited to, lighting, display screens, music, spoken audio words, temperature in the car, etc.

Advantageously, embodiments of the present disclosure provide elevator systems that improve the passenger experience via personalized, automated, non-intrusive learning of individual preferences.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes a device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations. Further, one of ordinary skill in the art will appreciate that the steps described in conjunction with the illustrative figures may be performed in other than the recited order, and that one or more steps illustrated may be optional.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of controlling an elevator system, the method comprising:

identifying a passenger;

collecting one or more frustration indicators of the passenger during usage of the elevator system by the passenger;

collecting one or more frustration factors;

correlating the one or more frustration factors to the one or more frustration indicators to generate one or more preferences for the passenger;

generating a profile for the passenger in response to the correlating, the profile including the one or more preferences; and controlling operation of the elevator system in response to the one or more preferences to reduce frustration of the passenger during interaction with the elevator system.

2. The method of claim 1 further comprising:

ranking the one or more frustration factors from more frustrating to less frustrating.

3. The method of claim 1 further comprising:

ranking the one or more preferences from most likely to reduce frustration to least likely to reduce frustration.

4. The method of claim 1 further comprising:

controlling operation of the elevator system to reduce total frustration of a group of passengers during interaction with the elevator system.

5. The method of claim 1 wherein:

the one or more frustration factors comprise internal frustration factors and external elevator factors.

6. The method of claim 5 wherein:

the internal frustration factors comprise one or more of conditions within the elevator car, wait time for the elevator car, number of other passengers in the elevator car, number of stops during travel and overall travel time.

7. The method of claim 5 wherein:

the external frustration factors include local traffic, local weather, time of day and day of week.

8. An elevator system comprising:

an elevator car located within an elevator shaft;

at least one sensor;

an elevator controller arranged to control travel of the elevator car; and a computing system in communication with the at least one sensor and the elevator controller, wherein the computing system is configured to implement:

identifying a passenger;

collecting one or more frustration factors of the passenger;

correlating the one or more frustration factors to the one or more frustration indicators to generate one or more preferences for the passenger;

generating a profile for the passenger in response to the correlating, the profile including the one or more preferences; and controlling operation of the elevator system in response to the one or more preferences to reduce frustration of the passenger during interaction with the elevator system.

9. The elevator system of claim 8 wherein:

the controller is configured to implement ranking the one or more frustration factors from more frustrating to less frustrating.

10. The elevator system of claim 8 wherein:

the controller is configured to implement ranking the one or more preferences from most likely to reduce frustration to least likely to reduce frustration.

11. The elevator system of claim 8 wherein:

the controller is configured to implement controlling operation of the elevator system to reduce total frustration of a group of passengers during interaction with the elevator system.

12. The elevator system of claim 8 wherein:

the one or more frustration factors comprise internal frustration factors and external elevator factors.

13. The elevator system of claim 12 wherein:

the internal frustration factors comprise one or more of conditions within the elevator car, wait time for the elevator car, number of other passengers in the elevator car, number of stops during travel and overall travel time.

14. The elevator system of claim 12 wherein:

the external frustration factors include local traffic, local weather, time of day and day of week.

15. A computer program product for controlling an elevator system, the computer program product comprising a non-transitory computer readable storage medium having program instructions embodied therewith, the program instructions executable by a processor to cause the processor to implement operations comprising:

identifying a passenger;

collecting one or more frustration indicators of the passenger during usage of the elevator system by the passenger;

collecting one or more frustration factors;

correlating the one or more frustration factors to the one or more frustration indicators to generate one or more preferences for the passenger;

generating a profile for the passenger in response to the correlating, the profile including the one or more preferences; and controlling operation of the elevator system in response to the one or more preferences to reduce frustration of the passenger during interaction with the elevator system.

* * * * *